United States Patent [19]

Ruiz-Fornells Gonzalez et al.

[11] 3,942,372

[45] Mar. 9, 1976

[54] PROCEDURE FOR MAKING TESTS OF PROPELLER CAVITATION

[75] Inventors: Ramon Ruiz-Fornells Gonzalez; Gonzalo Perez Gomez; Jesus Vivanco Sanchez, all of Madrid, Spain

[73] Assignee: Astilleros Espanoles, W.A., Madrid, Spain

[22] Filed: June 18, 1974

[21] Appl. No.: 480,519

[30] Foreign Application Priority Data

Mar. 14, 1973 Spain ..... 424286

[52] U.S. Cl. ..... 73/148

[51] Int. Cl.[2] ..... G01M 10/00

[58] Field of Search ..... 73/148, 432 SD

[56] References Cited

UNITED STATES PATENTS 2,378,412 6/1945 Lee ..... 73/148

FOREIGN PATENTS OR APPLICATIONS 1,438,819 4/1966 France ..... 73/148

OTHER PUBLICATIONS

Naval Ship Research & Development Report, No. 3039, M. da C. Vincent, Nov. 1971, pp. 19–21.

Saunders et al., U.S. Navy, "The David W. Taylor Model Basin," Apr. 1947, pp. 39–41, Report 569.

*Primary Examiner*—James J. Gill

*Assistant Examiner*—Anthony V. Ciarlante

*Attorney, Agent, or Firm*—Berman, Aisenberg & Platt

[57] ABSTRACT

A technique for testing marine propellers by analyzing the type of cavitation appearing on a reduced-scale model of the associated actual ship, and thereby obtaining data for correcting imperfections in propeller design, and for reducing pressure fluctuations at the lower sternframe portion of the ship. The technique inculdes simulating the water flow acting on the propeller. The procedure is characterized by adjusting the denominator of the cavitation index of the model in order to achieve an approach in the tests to equality between the cavitation indices of the model and the actual ship. This adjustment is achieved in the tests by increasing the towing speed or the propeller revolution rate of the model until the above-mentioned equality of cavitation indices is reached, ignoring the influence that the actual component of the wake speed due to wave formation might have in the tests. The procedure includes consideration of the increase in pressure of the propeller disc points due to the increased draught caused by the wave formation, and establishing a water line for the model corresponding to the loading condition to be tested, by the use of a steel sheet, or the like, on the hull of the model of adequate thickness and dimensions. The procedure enables tests to be conducted in conventional ship model basins without requiring vacuum, or in open water with the model in the loading condition desired, either floating on the surface or, made watertight and being totally submerged, taking into consideration the immersion of the model when the numerator of the above-mentioned cavitation index is calculated, and the tests being conducted at the speed for which the cavitation indices of the model and actual ship are equalized, the dimensional thrust coefficient $K_T$ of the model being identical to that of the actual ship.

11 Claims, 6 Drawing Figures

PROCEDURE FOR MAKING TESTS OF PROPELLER CAVITATION

Figure 1:
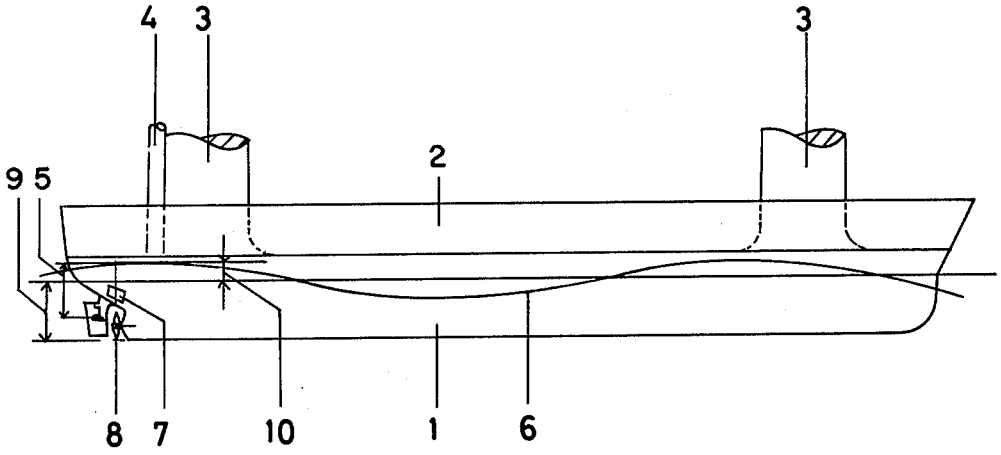

The present Specification refers to, a new procedure to effect tests of propeller cavitation, like for instance marine propellers, pump impellers, etc. Although the description of the procedure herein deals with the field of application of marine propellers since said propellers present the most complex problems for effecting a test, the procedure is applicable to any other type of impellers. Since the beginning of cavitation tests at the end of the last century, up to the present, the steps which have been employed in this field are the following:

1. Cavitation tests in the presence of a uniform flood tide.
2. Cavitation tests in the presence of a variable flood tide. The simulation of the variable flood tide began to be made by deploying metal nets, solids of revolution, etc. adjacent the propeller, whose purpose was to reproduce the axial variation of the wake speed.
3. Afterwards, the investigation techniques followed the trend of improving the simulation of the flood tide and therefore they began to introduce in the cavitation tunnels some streamlike bodies which stern-simulated generally simulated the stern forms of the vessel. The introduction of these stern bodies, not rigorously similar to those of the vessel, was necessary, provided that the installations existing during those days had not been thought of for effecting cavitation tests in the presence of a variable flood tide, and their dimensions were not able to allow use of a model fully similar to that of the vessel.

It was required the Reynolds number be sufficiently high, since the diameters of the propellers which were being tested were the biggest possible, compatible with some minimum blockade effects generated by the walls of the tunnel.

The scale at which the models of the propellers are built results in that the dimensions of the models of the hull, if these are to be rigorously similar to those of the vessel, be compatible with the dimensions of the watch cabin in the cavitation tunnels.

Aside from the differences stated in the previous item, the new tunnels of cavitation which have been built were of adequate dimensions so that in the inner part of the tunnel could be introduced models of forms rigorously similar to those of the vessel. In this type of tunnel, are simulated the components of frictional wake and potential wake, but not that of wave formation due to the fact that its effect is practicably insignificant in comparison with the two others. The comparison between the cavitation phenonema arising in the model and those noticed on the vessel, in those cases where measurements were made, has been quite acceptable.

4. In order to obtain the simulation of the wakes due to the wave formation, the subsequent step consisted in building circulation channels in which the water circulating has a free surface, with which the interaction between the water flow and the model of the vessel produces the formation of the wave at the head and stern of the model.
5. Finally, the most modern installations that have been made include the use of a testing tank in which the model is towed while the propeller turns.

The tank makes up a fully sealed enclosure in which vacuum can be maintained.

Until the present time the installations that have been built in the world to effect cavitation tests are characterised by the feature that for the realisation of the experiment or test it is necessary to provide a vacuum. It is admitted that the conditions for the cavitation phenomenon developed in the model to keep a certain likeness with that developed on the vessel, be the following:

1. Similarity of cavitation indexes
   - either as per the conventional cavitation index:

$$\sigma = \frac{P - Pv}{\frac{1}{2}\rho\, V_a^2}$$

- or either, following the reccommendation of the $$\sigma = \frac{P - Pv}{\frac{1}{2}\rho\, n^2 D^2}$$

2. Identity of dimensionless thrust deduction coefficient $K_T$.
3. That there is a certain similarity between the flood tide which acts on the propeller of the model and the flood tide received by the real propeller.

Until now all the experimation centers existing have followed the practice of simulating the cavitation index of the real vessel on the basis of diminishing the numerator of the index of cavitation of the model and therefore it was indispensable to provide a vacuum in the installation, since the speed $V_a$ or either the product nD of the model is lower than the one corresponding to the real vessel.

The essence of the procedure to effect cavitation tests, is characterised by the use of a procedure which is followed to make the indexes of cavitation equal which consists of increasing the denominator of the index of cavitation of the model until an index is obtained which is the same as that of the vessel, taking into consideration the pressure existing at the point of the model for which the index of cavitation is obtained.

When trying to equalize the cavitation indexes, corresponding to the vessel and the model, it was traditionally thought that since the denominator of the index of cavitation corresponding to the model is lower than the denominator corresponding to the index of cavitation of the vessel, the only possible procedure to obtain this would have to also include diminishing the numerator of the index of cavitation corresponding to the model.

The only possible procedure to diminish the numerator of the index of cavitation corresponding to the model would have to consist necessarily in imposing the vacuum on the circuit. This characteristic is the one which mostly burdens the cost of the installation.

It has been seen that while progress has been made in the knowledge of the phenomenon of cavitation, it has been judged that it was of the greatest need to reproduce in the tests a flood tide of similar characteristics to those which are received by the real propeller. Therefore it was advisable that the phenonemon of cavitation be reproduced in the presence of the stern shell of the model and there is no doubt that the best solution would have to consist of introducing in the enclosure where the test is being made the same model that has been tested in tow and self-propulsion.

The size of the model which is tested in tow and self-propulsion has been increasing in a continuous way during recent years, due to the fact that in the specific case of big tankers, the information available for the realisation of the extrapolations is scarce and therefore it was considered necessary to reduce as much as possible the scale effect of not complying with Reynolds' law.

The cost of the installations which are made necessary to effect the cavitation tests is enormously increased too by the foreseeable size of same taking into consideration that it is desirable that these have capacity for the models of big size.

The yield of these relatively expensive installations can be considered if they are analyzed commercially. It is thought that the greatest vulnerability of same consists in that it is only possible to effect in them cavitation tests, flood tide measurements and mostly, pressure fluctuations.

On the other hand, the modern solution which is the vacuum channel developed by the NSMB though it offers a great amplitude of possibilities, has price disadvantages which is the biggest argument against it when it is seriously considered to adopt said solution in other centers of experience of the future.

However, it is not necessary the cavitation tests be made in the presence of a certain degree of vacuum.

It has been mentioned that in the previously employed method vacuum is required so that in the tests the same cavitation number which the actual propeller has can be reached.

The cavitation index $\sigma_b$ of the actual propeller has the expression:

$$\sigma_b = \frac{(PO - e)_b}{V^2 \rho_b n_b^2 D_b^2} = \frac{(T + o - E)\ 1026 + 10100}{V^2 \rho_b n_b^2 D_b^2}$$

The index of cavitation $\sigma_m$ of the model propeller in the absence of vacuum will have the expression:

$$\sigma_m = \frac{\Sigma(T + o - E)\ 1026 + 10100}{V^2 \rho_m n_m^2 \quad \frac{D_b^2}{\lambda^2}}$$

where the subscripts $b$ and $m$ respectively refer to the actual propeller and the model propeller, and where $\lambda$ is the scale of the model T is the draught aft of the vessel E is the height of the propeller shafting $o$ is the elevation of the profile of the wave relative to the equilibrium surface of the sea in the vertical direction of the propeller $Po - e$ is the difference between the absolute pressure and that of the saturation of the steam of the liquid $\rho$ is the value of the density $n$ is the number of revolutions per second D is the diameter of the propeller V is the speed of advancement of the vessel To obtain a condition of equality of the cavitation indices for the actual propeller and the model it is necessary to comply with the following condition:

$$n_m = \lambda n_b \sqrt{\frac{\frac{1}{\lambda}(T + o - E)\ 1026 + 10100}{(T + o - E)\ 1026 + 10100} \cdot \frac{\rho_b}{\rho_m}} \qquad (1)$$

Because the thrust coefficient $K_T$ of the model in the tests should be the same as that of the actual vessel, the advancement speed $(V_A)_m$ of the model should be related to the speed $(V_A)_b$, namely, that of the actual vessel.

This condition is expressed as follows:

$$(V_A)_m = J_b D_b n_b \sqrt{\frac{\rho_b}{\rho_m} \cdot \frac{\frac{1}{\lambda}(T + O - E)\ 1026 + 10100}{(T + o - E)\ 1026 + 10100}}$$

where $J_b$ is a constant such that $$J_b D_b n_b = (V_A)_b$$

From this is obtained the expression:

$$(V_A)_m = (V_A)_b \sqrt{\frac{\rho_b}{\rho_m} \cdot \frac{\frac{1}{\lambda}(T + O - E)\ 1026 + 10100}{(T + o - E)\ 1026 + 10100}} \qquad (2)$$

$(V_A)_m$ is the average speed of the water which acts on the model propeller where said model works with a thrust index value $K_T$ corresponding to that of the real propeller.

This speed is considerably greater than the one which will corresponding speed in a test of self-propulsion which was made following Froude's law When:

$$\lambda = 1$$

It happens that:

$$(V_A)_m = (V_A)_b \sqrt{\frac{\rho_b}{\rho_m}} \qquad (3)$$

and besides the effective wakes of the model and vessel would be equalled.

In the event that $\lambda$ tended to become infinite, (model infinitely small), one would get to:

$$(V_A)_m = (V_A)_b \sqrt{\frac{\rho_b}{\rho_m} \quad \frac{10100}{(T + o - E)\ 1026 + 10100}} \qquad (4)$$

While the size of the model is increased, it also increases the value of the speed $(V_A)_m$ getting to the value given by equation (3) if the model were as big as the vessel itself.

On the contrary, the smaller the size of the model, the smaller the value of $(V_A)_m$ will be, without this value being less than that of equation (4). As per the reasons given above, there is no difficulty against effecting the cavitation tests in the absence of vacuum.

When obtaining the equality of indexes of cavitation by means of increasing the revolutions of the model propeller, it becomes necessary to impose a propulsive force upon the model ship, which alleviates the load on the propeller until the model works with the index $K_T$ desired, while it rotates with a rate of revolutions $n_m$ adequate to obtain the index of cavitation of the vessel.

As a consequence, it is possible to reproduce the phenomenon of cavitation employing the conventional testing tanks. For that end it is necessary that the drive means of their test carriages be adequate for their obtaining the necessary $(V_A)_m$ speed, simultaneously supplying to the model the adequate impulsing force.

It is expected that in the near future, models of a large size will be built, incapable of being tested in the present testing tanks because of their dimensions, with which speed trials will be made, similar to those of the actual vessels, these models being free and being self-propelled by propulsion devices similar to those of the real vessel. Since data for friction deduction for the self-propulsion tests does not exist, the results of these tests will be extrapolated by Taniguchi's procedure. With these models, also maneuverability tests will be made and also it is expected that there will be the possibility of making simultaneous tests of cavitation and of pressure fluctuations. It has been observed that for the reproduction of the cavitation phenomenom it is necessary that the model advance at a certain speed which is obtained by propelling it with an additional force. At the same time, the propeller should rotate at such speeds or rates of revolution that these allow the obtainment of the cavitation index of the real propeller. The additional impulsing force should be such that the propeller works with the coefficient $K_T$ of the real propeller. The propulsion could be made by towing the model by means of a constant tension winch or similar device, pushing it with a tug, or either driving it by an air propeller, or by means of other marine propellers adequately situated so that they do not disturb the flood tide which the propeller whose behaviour it is desired to study receives. These last procedures appear to be the most adequate ones due to the autonomy provided by the model. No matter propelling device is employed, it should be of nature which permits that its propelling force be graduated widely so that it can be so adjusted that the model propeller under test works with the $K_T$ coefficient, which corresponds to that of the real propeller. It should also be characterised by the fact of not disturbing the waters situated ahead of the model.

Therefore the new procedure is based on increasing the denominator of the cavitation index of the model, for which it will be necessary that either the rate of revolution of the propeller or the towing speed of the model (as per that the expression of the cavitation index adopted be what is reccommended by the 11 ITTC or the conventional one) be the adequate one to obtain the already cited equality of indexes between model and real vessel, not being therefore necessary in the procedure, to make vacuum tests the tests being made not only in conventional testing tanks, existing or new, but also on the sea or at a lake, the selection of the place for making the tests depending on the dimensions and characteristics of the model, and therefore of the vessel. As per this new procedure, the tests can be made on the surface or with the model, duly watertight, fully submerged, and in the tests can be adopted, as per convenience, the following measures in the simulation of the wake speed due to the formation of waves:

A. ignore the influence of the axial component of the wake speed due to the formation of waves, taking only into consideration the pressure increase which is produced on the points of the propeller due to the increase of the draught aft.

B. accept the formation of the waves, insuring that the water flood tide which acts upon the propeller disc of the model is similar to the one which would be produced on its cavitation tunnel, materialising the corresponding waterline plan to the load situation expected through use of a steel plate of adequate thickness and sizes.

C. materialisation of the waterline plan through use of the aforesaid plate, guaranteeing that the water flood tide on the propeller disc will be the adequate one, reducing to the minimum the free-board of the model and making this watertight for the making of the test, with the model fully submerged.

The most serious problems of visualisation of the cavitation phenomenon developed by the propeller is presented in the conventional testing tanks.

Due to the relatively high speeds at which the tow carriage should be moved, this carriage runs the length of the channel in a relatively short time. Since the time available for contemplating the cavitation developed, is very small, it is believed that direct the visual inspection, should be disregarded, and that it should be transmitted by a closed television circuit, with the possibility of obtaining a simultaneous recording. Another possibility could be to register it on a high speed film, whose later projection would allow the making of appropriate analyses.

In both cases simultaneous views could be made of the active face and the back of the propeller to observe any type of cavitation which is presented in same.

In the event that the test is made on a big size model, while it sails, being helped by its marine propeller and with the additional push capacity supplied by its air propeller or from any other impulsion system such as has been previously indicated, it will be enough to make a film registration of the phenomenon, using for that end a high-speed camera. Additionally, the projection of the stern structure of the model can be taken simultaneously with measurements for it therefore making it possible to provide a direct inspection of the cavitation process.

Not only if the inspection of the process is ocular and direct but also if it is kept in a film or is obtained through a television circuit, it is indispensable to employ adequate stroboscopic equipment.

Herewith below is a detailed description of the new procedure in accordance with the invention, with reference to the drawings which are attached, in which it is represented by way of just like an example, not limitative, a preferred form of the invention, susceptible of those detail variations which do not require a fundamental alteration of the essential characteristics of the invention.

In said drawings is illustrated:

FIG. 1 — A side elevational view of the test model, as per the mode of the procedure which ignores the axial component of the wake speed due to he formation of the waves.

Figure 2:
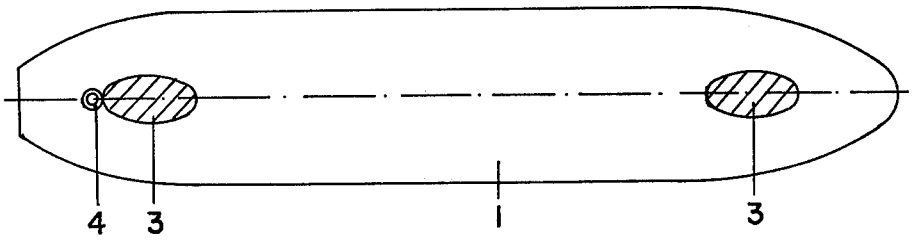

FIG. 2 — A plan view from a higher point of view of the model corresponding to FIG. 1.

Figure 3:
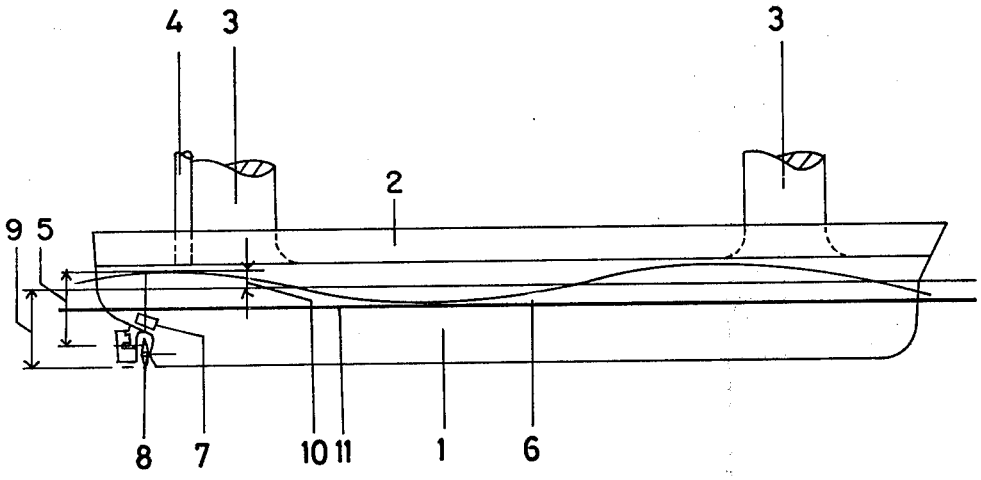

FIG. 3 — A side elevational view of the test model as per the mode of the procedure including accepting the formation of the waves, materialising the waterline plan corresponding to the load situation expected and making the test on the surface.

Figure 4:
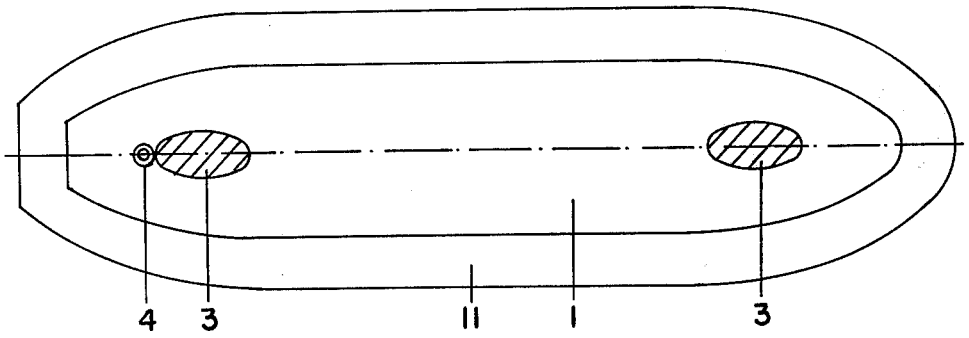

FIG. 4 — A plan view from a higher point of view of the model corresponding to FIG. 3.

Figure 5:
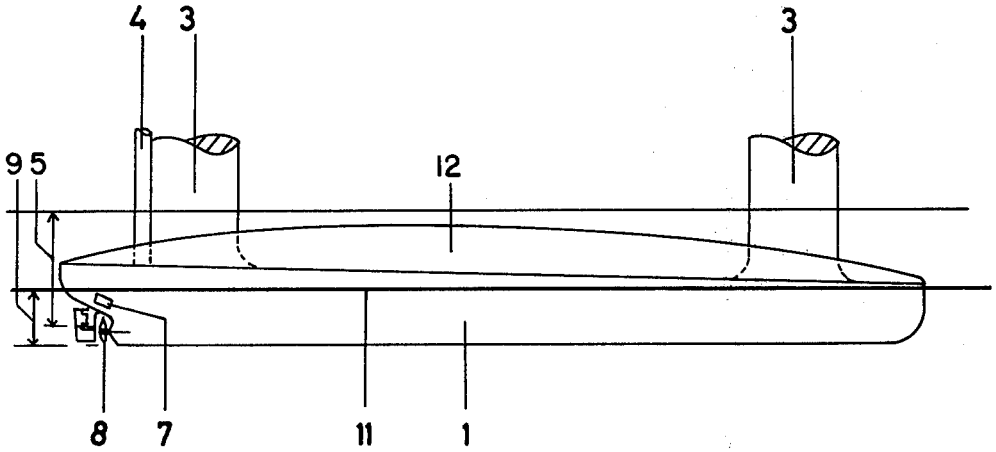

FIG. 5 A side elevational view of the test model as per the mode of the procedure including accepting the formation of the waves, materialising the waterline plan corresponding to the load situation expected and making the test with a watertight model fully submerged.

Figure 6:
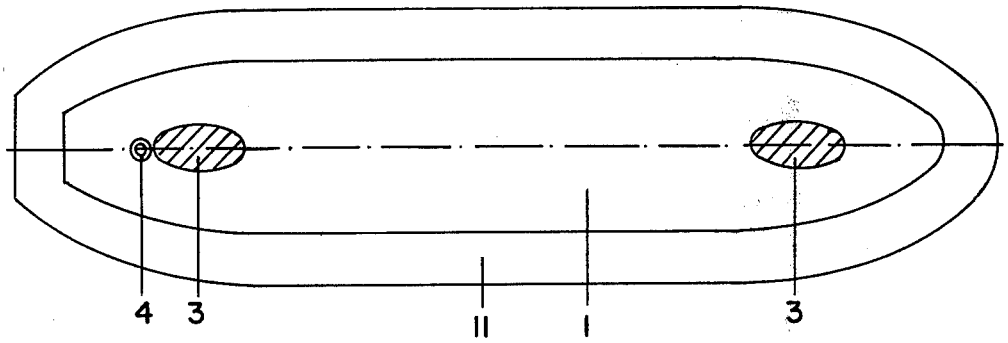

FIG. 6 — A plan view from a higher point of view of the model corresponding to FIG. 5.

It has been previously mentioned, in the exposition of the essential basis of the procedure which is known, that to obtain the cavitation number which corresponds to the real propeller it is necessary that the model advance at a speed considerably higher than that which would correspond to it if it followed Froude's law of similarity. The result is that the waves which the model will produce when advancing at the adequate speed so that the expected cavitation index is obtained, are higher, not corresponding to reality. For this problem, the following measures can be adopted:

Ignore the influence of the axial component of the wake speed due to the formation of the waves which appear in the test. Under these circumstances, the method illustrated in FIGS. 1 and 2 (no steel plate) may be employed.

This measure, reflected in FIGS 1 and 2, implies that the model 1 should be provided with a maximum freeboard or protection area 2 so that the model does not take on water. Said model 1 will be provided with the hitch holders 3 adequate to serve as the lag means for the outgoing cables 4 of the cables of the watching instruments of the test which the model should bear. By the line 5 is indicated the immersion area of the model, representing the total height of the formation of the wave 6. The area 7 corresponds to the watching area of the test.

There will only be taken into consideration at this stage of the procedure, making the test through tow or additional propulsion of the model afloat at the load condition desired and at the speed for which the cavitation indexes are equalled, and also the increase in pressure which is produced on the points of the disc of the propeller 8 due to the increase of the draught aft 9 which is generated by the formation of the wave 6. When calculating the value of the parameter "o" (lifting of the profile of the wave 6 on the equilibrium surface of the sea in the vertical direction of the propeller 8) represented by 10 there will be taken into consideration the height of the profile of the wave 6 in the plane of the propeller disc 8.

B. Accept the formation of the waves, but in turn arrange that the water flood tide which acts on the propeller disc 8 of the model 1 be similar to that which would be produced on its cavitation tunnel with no resistance of free surface, eliminating in this way any self-defeating influence which might affect the wake component due to the formation of waves in some events.

This measure, reflected in FIGS. 3 and 4 and where the same reference numbers used in FIGS. 1 and 2 are used to indicate the same terms, would be translated into the construction of the model 1 with a big pillar, being the condition associated with a draught equal to that corresponding to the load situation which is the object of the test.

The waterline plan corresponding to the load situation which is desired to test is realized through the use of a steel plate 11 of an adequate thickness and which adequately stands out over the longitudinal and transversal dimensions of the model 1. Logically, the profile of the wave 6 should always remain above the plate 11, though this requirement is not absolutely indispensable.

The plate 11 guarantees that the water flood tide incident on the propeller 8 will be similar to the one the model would have on the self-propulsion tests corresponding to the Froude number of the vessel, with the reservation of having eliminated the influence of the wake speed component due to the formation of waves. In calculating the cavitation index of the model it will be necessary to take into consideration the immersion of the propeller 8 with respect to the profile of the wave 6 which is formed. Preferably, this measure will be adopted when it is intended to make tests with big size models on the sea or on a lake, these tests logically being made by means of towing the vessel by adequate means, the model being afloat, and moving and at the speed for which the cavitation indexes are equaled.

In this measure, reflected in FIGS. 5 and 6, it is intended to materialise the waterline plan in the way indicated in measure B, use of steel plate 11 and instead of increasing the free-board of the model to the maximum, same is reduced to the minimum possible so that afterwards, once introduced and the instruments set, the model can be first sealed with a streamlined watertight cap 12, and then tests are made with the model fully submerged. The plate 11 will guarantee that the water flood tide on the disc of the propeller 8 will be the adequate one. The immersion of the model 1 will be taken into consideration when the numerator of cavitation index is calculated. This form of actuation will be adopted, preferably, when the tests are made in conventional testing channels, said test being logically made through towage of the model by adequate means, the model being fully submerged, and moving at the speed for which the cavitation indexes are equaled, this measure offering the advantage that the necessary traction forces to tow the model are reduced considerably by having eliminated the component of the resistance, due to the formation of the waves. As to the influence on the tests of the wake speed component due to the formation of waves, in measures A, B or C above described, this new procedure cannot offer the possibilities of the vacuum channels which due to a high cost are provided with different characteristics, being in turn analogous to the cavitation tunnels which do not have a free surface, not being affected by the blockade effect existing in these latter ones.

It must be taken into consideration that for vessels for which the speed is lower, to a Froude number of 0.3 the component which has been ignored has a practically insignificant influence.

The visualisation of the tests, not only in the vacuum tanks but also in this new procedure, has the fault of not being comfortable and is temporarily limited, unless the tests are repeated, which on the other hand, does not mean any serious inconvenience.

With regard to the technology used for visualising the test, it can be affirmed that the procedure set in the new vacuum tank of the NSMB is fully applicable to the procedure which is known.

Nevertheless, the cheapest method of visualising the tests as per this new procedure consists in filming the test with high speed cameras and make the analysis of the phenomenom by projecting the film at an adequate speed. This method of visualisation offers the possibility of going back on the film thus facilitating a review which is worthwhile taking into consideration.

In the event of making the tests with big size models in free waters there is the possibility of obtaining a direct visualisation, besides the other visualisation possibilities mentioned above.

In constructing new testing tanks in which it is contemplated making the same tests of cavitation following this new procedure, their length should not be less than 450 meters. In this way, in those tests which are made at a speed of 10 m/sec. (really critical) there would be available some thirty seconds nett for filming time.

To take advantage of the possibilities which are derived from this exceptional tank length, it would be advisable that two experiment or test carriages be installed, with bases on the ends opposite the tank, by means of which the experimenting possibilities would be doubled. To avoid the possibility that the waves produced by one of the models which is tested in one of the carriages could disturb the waters through which the other model has to pass, there is the possibility of having available, transversally, wirecloth rolls in the center of the tank in order to absorb the water oscillations.

With regard to the Reynolds' number of the test, this new procedure has advantages exceeding the possibilities offered by the vacuum tunnel, since in the vacuum technique in order to reach in the tests the Froude's number of the vessel, the carriage speed cannot excede 4,5 m/sec. The greater the Reynolds' number is on the tests (counting on the non production of the waves associated at that speed), the less will be the thickness of the top layer of the model and therefore th flood tide will be more similar to that of the true vessel.

On the other hand, the circulation speed in the vacuum tunnels when inside them are introduced tridimensional models, rarely exceeds 4 m/sec., with which the Reynolds number will be quite lower. The speed in the circulation tunnels with a free surface is likewise less. In the tunnels for simulation of axial components, speeds of up to 8 m/sec. can be reached, but the consequences of the tri-dimensional flood tide in this case make useless any comparison of possibilities. With regard to the Froude number in the tests, this new procedure offers similar possibilities to those of the cavitation tunnels without a free surface.

With regard to the blockade effect on the part of the walls of the conduit or of the installation in this new procedure, this effect is comparable to that of the vacuum tank. It has been stated previously that the existence of this effect was the reason whereby even in the hypothetical event that the flood tide of the model and of the vessel is similar, the identity of values $K_T$ and J were not produced simultaneously for the vessel and for the model.

With regard to the reproduction of a tri-dimensional flood tide, the possibilities of this procedure are comparable only to those of the cavitation tunnels of a big size with a possibility of introduction inside them of models of 8 mts. or larger, and with those of the vacuum tanks.

With regard to the preparation of the water, since it is not necessary to employ a vacuum in this new procedure, the importance is reduced in the development of the cavitation of the air and gas contents not dissolved in the water.

The great advantage of this procedure with respect to the cost and yield of the installations necessary for the development of the tests is readily apparent, being susceptible of application to presently existing tanks with nothing else required but making the appropriate changes in the test carriages and visualization means.

In the event of making tests simultaneously of cavitation and pressure fluctuations, the installations proposed for tanks higher to 450 mts. or up would undoubtedly offer more advantages in possibilities than those which could be offered by a vacuum tunnel. Their technical advantages would only be comparable to those of a vacuum tank, which would have less possibilities of making conventional tests.

The advantages set in this new procedure to effect cavitation tests, are substantial in comparison to other known procedures, its main feature being the possibility of effecting the tests without requiring vacuum, with the subsequent economisation of the necessary installations and the possibility of making the tests in conventional testing tanks or in free water.

In brief, this new procedure consists in the equalisation of the cavitation indexes of the model and of the true vessel through the increase of the denominator of the cavitation index of the model, taking into consideration the pressure existing at the point of the model at which said cavitation index is obtained, said equality being obtained through the increase, either of the rate of revolution of the propeller or of the speed of towage of the model, according to the index of cavitation adopted. Thus, the tests can be made with the model on the surface or duly watertight, fully submerged, it being guaranteed under any circumstances, that the water flood tide which acts on the disc of the propeller of the model is similar to that which would be produced in its cavitation tunnel, and employing various measures in the procedure, according to the test, with regard to the axial component of the wake speed due to the formation of waves, which as has previously been mentioned, has a practically negligible influence for vessels whose speed is lower than that giving a Froude number of 0.3.

The form, materials and sizes of elements employed can be varied, provided that it does not alter, change or modify the general concept of the procedure which is herein described. The terms with which this invention is described are typical, and should be taken broadly and never in a limitative way.

What is claimed is:

1. A method of visualizing cavitation phenomena produced by the propeller of a vessel, comprising mounting a scale model propeller on a corresponding reduced scale model of the associated ship, driving said scale model ship under ordinary atmospheric pressure conditions through a body of water open to atmosphere at a speed $(V_A)_m$ and simultaneously operating the scale model propeller at a rate $n_m$ such that the same cavitation index $\sigma$ and the same thrust coefficient $K_T$ are obtained as for the associated ship, and wherein said cavitation index for a vessel with a propeller is given by $$\sigma = \frac{(T + o - E)\ 1026 + 10100}{V^2\ \rho\ n^2\ D^2}$$

where

T is the draught of the vessel $o$ is the elevation in the vertical of the propeller tips of the wave generated by the vessel E is the height of the propeller shaft V is the speed of the vessel $\rho$ is the water density $n$ is the number of revolutions per second of the propeller and D is the diameter of the propeller, and wherein said thrust coefficient is given by $$K_T = \frac{T}{\rho\ n^2\ D^4}$$

in which

T is the thrust $\rho$ is the water density $n$ is the number of revolutions per second of the propeller and D is the propeller diameter and observing the cavitation conditions in the region adjacent the scale model propeller.

2. The propeller testing method of claim 1, and establishing a water line for the reduced scale model ship corresponding to a predetermined loading condition of said actual associated ship.

3. The propeller testing method of claim 2, and wherein the water line for the scale model ship is established by employing a sheet member projecting outwardly from the scale model ship.

4. The method of claim 1, and wherein the reduced scale model ship is floated in a model basin.

5. The method of claim 1, and wherein the adjustment for obtaining equality of said cavitation indices is obtained by varying te rate of propulsion of the reduced scale model ship through the water.

6. The method of claim 1, and wherein the adjustment for obtaining equality of said cavitation indices is obtained by varying the rate of rotation of the scale model propeller.

7. The method of claim 1, and visually observing cavitation conditions in the region of the scale model ship adjacent the scale model propeller.

8. The method of claim 7, and wherein observation of said cavitation conditions is performed by employing a closed circuit television channel.

9. The method of claim 7, and wherein observation of said cavitation condition is performed by employing a high speed motion picture camera located to obtain views of cavitation occurring at surfaces of the scale model propeller.

10. The propeller testing method of claim 1, and establishing a water line for the reduced scale model ship corresponding to a predetermined loading condition of said actual associated ship by employing a sheet member projecting outwardly from the scale model ship, with the scale model ship submerged and sealingly covered while it is propelled through the water.

11. The method of visualizing cavitation phenomena of claim 1, and wherein the scale model ship is fully submerged while being driven through said body of water.

* * * * *

UNITED STATES PATENT AND TRADEMARK OFFICE

CERTIFICATE OF CORRECTION

PATENT NO. : 3,942,372

DATED : March 9, 1976

INVENTOR(S) : Ramon Ruiz-Fornells GONZALEZ, Gonzalo Perez GOMEZ and Jesus Vivanco SANCHEZ It is certified that error appears in the above-identified patent and that said Letters Patent are hereby corrected as shown below:

Title page, at [30] Foreign Application Priority Data, "Mar. 14, 1973" should read --Mar. 14, 1974--.

Signed and Sealed this

*Twenty-third* Day of *November 1982*

[SEAL]

*Attest:*

GERALD J. MOSSINGHOFF

*Attesting Officer*

*Commissioner of Patents and Trademarks*